US011612205B2

(12) United States Patent
Oshman

(10) Patent No.: US 11,612,205 B2
(45) Date of Patent: Mar. 28, 2023

(54) INTEGRATED MAGNET BASED MOUNTING SYSTEM

(71) Applicant: Helmet Flair LLC, Boulder, CO (US)

(72) Inventor: Shaun David Oshman, Boulder, CO (US)

(73) Assignee: Helmet Flair LLC, Boulder, CO (US)

( * ) Notice: Subject to any disclaimer, the term of this patent is extended or adjusted under 35 U.S.C. 154(b) by 81 days.

(21) Appl. No.: 17/187,558

(22) Filed: Feb. 26, 2021

(65) Prior Publication Data

US 2021/0259348 A1 Aug. 26, 2021

Related U.S. Application Data

(60) Provisional application No. 62/982,030, filed on Feb. 26, 2020.

(51) Int. Cl.
*A42B 3/04* (2006.01)

(52) U.S. Cl.
CPC ..... *A42B 3/0406* (2013.01)

(58) Field of Classification Search
CPC ..... A42B 3/0406
USPC ..... 2/410, 6.2
See application file for complete search history.

(56) References Cited

U.S. PATENT DOCUMENTS

| | | | | |
|---|---|---|---|---|
| 3,381,308 | A * | 5/1968 | Fineberg | A42B 1/004 D2/870 |
| 5,193,226 | A * | 3/1993 | Mortenson | A42B 3/166 2/422 |
| 6,175,963 | B1 * | 1/2001 | Loeffelholz | A42B 1/248 2/200.1 |
| 6,718,559 | B1 * | 4/2004 | Davidson | G09F 21/02 24/324 |
| 2007/0022514 | A1 * | 2/2007 | Paulson | A42B 1/248 2/171 |
| 2014/0259266 | A1 * | 9/2014 | Federlin | A41F 1/002 2/69 |
| 2015/0338723 | A1 * | 11/2015 | Duncan | H04N 5/2252 396/419 |
| 2016/0360810 | A1 * | 12/2016 | Lim | A41F 1/002 |
| 2017/0360139 | A1 * | 12/2017 | Aguilera Robles | A42B 3/068 |
| 2018/0078780 | A1 * | 3/2018 | Sun | H01F 7/0221 |
| 2018/0201181 | A1 * | 7/2018 | Cook | B62L 3/02 |
| 2019/0008228 | A1 * | 1/2019 | Ramey | A42B 3/044 |

* cited by examiner

*Primary Examiner* — Timothy K Trieu
(74) *Attorney, Agent, or Firm* — Holland & Hart

(57) ABSTRACT

The disclosed technology includes methods, systems, and apparatus related to utilizing high strength magnets to adhere accessories, decorative units, and other features to a helmet without compromising the safety features of the helmet. The magnets may be attached in magnet-based mounting systems to the helmet or integrated into the helmet. The mounting systems may include rare-earth magnets and high strength adhesives to adhere to a helmet surface and maintain attachment during high speed or contact, such as during sports activities. In some embodiments, accessories, decorative units, and other features include electronics for lighting, music, video, GPS, or other features.

18 Claims, 9 Drawing Sheets

INTEGRATED MAGNET BASED MOUNTING SYSTEM

BACKGROUND

The following relates generally to helmet systems, magnet-based mounting systems, apparatuses, and methods related to same.

Many states have laws requiring helmet usage with a focus on the safety of children. Most helmets have a uniform and undesirable appearance. In the eyes of children, helmets are "not cool." Children resist wearing helmets for sports, for example, when biking and skateboarding.

In an effort to decorate helmets, some helmet add-on products (e.g., stickers or three-dimensional attachments) use permanent adhesives to adhere to the helmet. There is no ability to easily change out the attached product for another product, and the design is static. As a result, a user is required to purchase a new helmet in order to change the appearance of their helmet. In other cases, some helmet add-on products use suction cups to adhere helmet add-on products to the helmet, and the add-on products fall off easily.

SUMMARY

The disclosed technology includes helmet systems, magnet-based mounting systems, apparatus, and methods related to same. Specifically, the disclosed technology includes magnet-based mounting systems which mount accessories, decorative units, and other features to a helmet without compromising the safety features of the helmet. In some embodiments, the disclosed technology includes helmet systems, including helmets with integrated magnet-based mounting systems.

In some embodiments, the disclosed technology includes a magnet-based mounting system, including at least one decorative top, each decorative top including a decorative unit, a mount plate to mount into the decorative unit, a first adhesive to secure the mount plate to the decorative unit, a metal disk to adhere to the mount plate, and a second adhesive to secure the metal disk to the mount plate, and at least one magnetic base to connect a corresponding decorative top to a helmet, including a mount cover, a first magnet to adhere to the mount cover, and a third adhesive to secure the mount cover to the first magnet.

In some embodiments, the disclosed technology includes a helmet system, including a helmet and magnet-based mounting system, with at least one magnetic base that is integrated in the helmet.

In some embodiments, the disclosed magnet-based mounting system includes at least one magnetic base affixed on an exterior surface of the helmet. In some embodiments, wherein the at least one magnetic base can be affixed on an interior surface of the helmet, and the decorative top can be affixed to an exterior surface of the helmet, and the at least one magnetic base is configured to connect to the helmet opposite the decorative top via a magnetic force between the magnet in the magnetic base and the metal disk decorative top.

In some embodiments, the disclosed technology includes a helmet including a power source, electrical wiring integrated into the helmet to transfer power from the power source to a plurality of components, at least one decorative top, each decorative top including a decorative unit, a mount plate to mount into the decorative unit, a first adhesive to secure the mount plate to the decorative unit, a steel disk to adhere to the mount plate, and a second adhesive to secure the metal disk to the mount plate, and at least one magnetic base integrated into the helmet to connect a corresponding decorative top to the helmet, including a mount cover, a first neodymium magnet to adhere to the mount cover, and a third adhesive to secure the mount cover to the first magnet.

In some embodiments, the disclosed technology includes a method of attaching a decorative top to a helmet in a magnet-based mounting system including attaching a magnetic base to a helmet with an adhesive, the magnetic base including a mount cover, a first magnet to adhere to the mount cover, and the adhesive to secure the mount cover to the first magnet and to the helmet, adhering a decorative top to the magnetic base, the decorative top including a decorative unit, a mount plate to mount into the decorative unit, a first adhesive to secure the mount plate to the decorative unit, a metal disk to adhere to the mount plate, and a second adhesive to secure the metal disk to the mount plate.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various embodiments as further illustrated in the accompanying drawings and defined in the appended claims.

These and various other features and advantages will be apparent from a reading of the following Detailed Description.

BRIEF DESCRIPTIONS OF THE DRAWINGS

DETAILED DESCRIPTIONS

Figure 1:
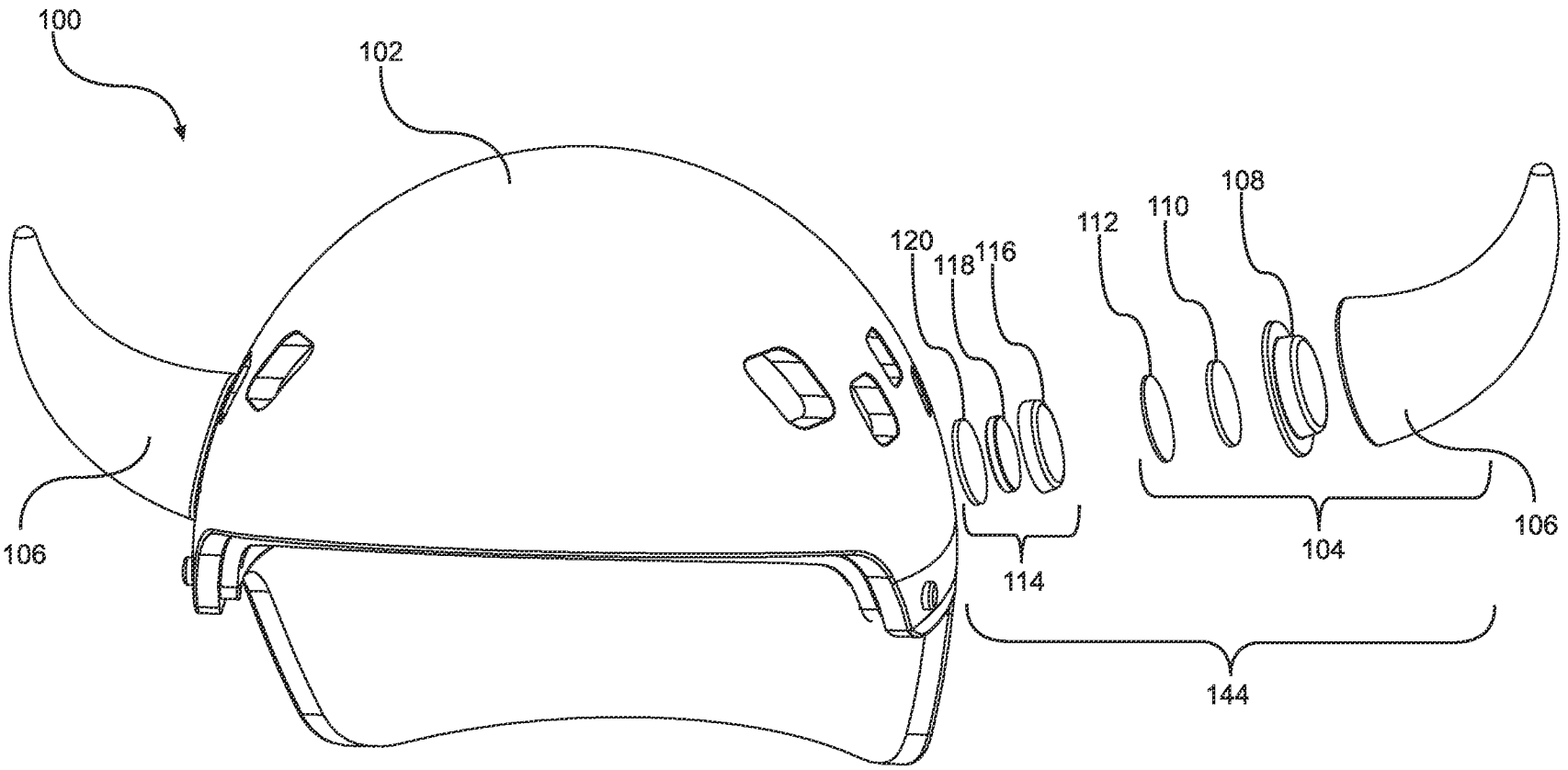
FIG. 1 is a perspective view of an example magnet-based mounting system in accordance with examples as disclosed herein.

In the following description, for the purposes of explanation, numerous specific details are set forth in order to provide a thorough understanding of the present invention. It will be apparent, however, to one skilled in the art that the present invention may be practiced without some of these specific details. For example, while various features are ascribed to particular embodiments, it should be appreciated that the features described with respect to one embodiment may be incorporated with some embodiments as well. Similarly, however, no single feature or features of any described embodiment should be considered essential to the invention, as some embodiments of the invention may omit such features.

Generally, the described technology provides for methods, systems, apparatuses related to utilizing powerful magnets to attach attachments (e.g., accessories, decorative units, and other features), which include metal, without compromising the safety features of the helmet. For illustration, the attachments used in the figures herein are decorative units, but any attachment may be used. Further, in some examples the mounting systems may be described as having one mounting system, one magnetic base, or one top, however, any numbers of mounting systems and other components may be used in the disclosed technology.

In some implementations, the magnet-based mounting systems refers to the mounting system that can be attached to a helmet, or other apparatus. In some implementations, the magnet-based mounting systems are integrated into a surface of the helmet and may be referred to as helmet systems. For example, the magnetic base or part of the magnetic base of the magnet-based mounting system may be integrated into the helmet liner of the helmet.

The magnet-based mounting systems in the disclosed technology may include rare earth magnets and high strength adhesives to adhere to a helmet surface. Rare earth metals are metals that are ferromagnetic and are strong permanent magnets which produce stronger magnetic fields than other types of magnets.

The mounting systems can mount a top unit to a helmet to withstand a user traveling at approximately 180 mph in a head down free fall without disruption of the magnetic attachment of the top to the magnetic base.

The disclosed magnet-based systems allow attachments to sheer off the helmet in the case of an impact. In some embodiments, the magnetic base is permanently mounted to the helmet with double sided adhesive or incorporated into the manufacture of the helmet. The magnetic base is sufficiently low profile that it would not affect the protection dynamics of the helmet. In the event of a crash, an attached decorative or functional attachment would sheer off, allowing the helmet to perform the job it is designed to do.

The disclosed technology satisfies a user's desire to have more personal expression and features while wearing a helmet and allows for swift swapping of attachments. Users can change out the attachments as their moods change or they have a new functional requirement. A user is not required to purchase a new helmet in order to incorporate new attachments. For example, the user can have three sets of blinking devil horns surrounding a unicorn horn with a set of pony tails out the back all being videoed by their GoPro mounted using the same strong magnets.

In some embodiments, the magnets give the foundation for other features such as a power supply to the attachments. The magnets also allow for the transfer of power coming from a centralized battery bank mounted on the helmet. Wiring run under, in, or on the surface of the helmet shell allow each of the magnetic bases, which will include conductive surfaces, to be powered from the power supply. As a result, powered attachments that adhere to the magnetic based share a centralized power source. Power management becomes simplified and the attachments become lighter and cheaper to manufacture. In some embodiments, switching may be controlled by at least one of the magnets in the magnetic bases or magnetic mount points.

The mounting system components may be made of various materials and the mounting systems may include various features. For example, the disclosed magnet-based mounting system may include a disk made of any metal (e.g., steel, iron, nickel, etc.) attracted to magnets. The magnets are contemplated to be any strong magnets. In some embodiments, the magnets are rare earth magnets, such as neodymium or samarium-cobalt magnets. In some embodiments, LED lights, music, video, GPS, wireless technology or other features may be integrated into the magnetic latching system. The magnets in the mounting systems may be used for switching for the LED lights or other features. In some embodiments, the decorative unit comprises a cavity for electrical components or storage of other components. For example, a cavity inside the decorative top may allow for space to add features such as Bluetooth connectivity for smart navigation features such as turn signals for cyclists.

In some embodiments, a power source (e.g., a battery pack) may be attached to the mounting system (e.g., the decorative top) or to a helmet. Electrical wiring may be integrated into the helmet to power the magnetic bases. In some embodiments, the helmet includes a conductive surface.

If additional holding power is required for a heavier attachment, additional corresponding magnets may be installed to increase the holding force to the helmet. For example, a decorative top may include a heavier attachment. The decorative top may have a corresponding magnet installed, in addition to the magnet located in the magnetic base. This will increase the holding force of the decorative top to the magnetic base and the helmet.

Features of the disclosure are initially described in the context of an example magnet-based mounting system used with a helmet as described with reference to FIGS. 1-4. Features of the disclosure are then described in the context of an example magnet-based mounting system integrated into a helmet with reference to FIGS. 5 and 6. Features of the disclosure are then described in the context of an example integrated power supply system with a magnet-based mounting system integrated into or used with a helmet with reference to FIG. 7. These and other features of the disclosure are further illustrated by and described with reference to the flowchart in FIG. 8 that relates to using a magnet-based mounting system.

FIG. 1 is a perspective view of an example magnet-based mounting system 100. The mounting system in the magnet-based mounting system 100 may be used to mount attachments (e.g., decorative units) to a helmet 102, also shown in FIG. 1. In other embodiments, the attachments may be other non-decorative and functional or accessory features.

As shown, the magnet-based mounting system 100 includes two decorative tops 104 (one of which is unassembled to display the components parts), and a magnetic base 114 (which is unassembled to display the components parts). The magnetic base 114 is coupled to the decorative top 104 to the helmet 102 by a magnet.

The decorative top 104 includes a decorative unit 106, a mount plate 108 to mount into the decorative unit 106, a first adhesive 110 to secure the mount plate 108 to the decorative unit 106, a metal disk 112 to adhere to the mount plate 108. A second adhesive (not shown) may also be included to secure the metal disk 112 to the mount plate 108.

The magnetic base 114 includes a mount cover 116, a magnet 118 to adhere to the mount cover 116, and a third adhesive 120 to secure the mount cover 116 to the magnet 118. The mount cover 116, which may be plastic, encases the magnet 118 to protect the magnet 118 form damage. In some implementations, adhesive may be used on both sides of the magnet 118 to attach the magnet 118 to both the inside of the mount cover 116 and to the surface of the helmet 102 itself.

The magnet-based mounting system 100 may include any number of decorative units 106, or other features requiring a magnet-based mounting system for attachment to a helmet. The components of the magnet-based mounting system 100 may be made of various materials. For example, the adhesives (e.g., the first adhesive 110, the second adhesive (shown in FIG. 2, as 222, the third adhesive 120) may be adhesive tapes or other adhesive products (e.g., 3M™ VHB™ Tapes, a liquid adhesive, a double-sided adhesive, etc.). A variety of magnets may be used, such as rare-earth magnets (e.g., neodymium). The metal disk 112 may be any metal (e.g., steel) that are attracted by a magnetic force to magnets sufficiently to affix decorative items and other features to a helmet. The mount plate 108 may be made of various materials, and in some case, may be molded.

Figure 2:
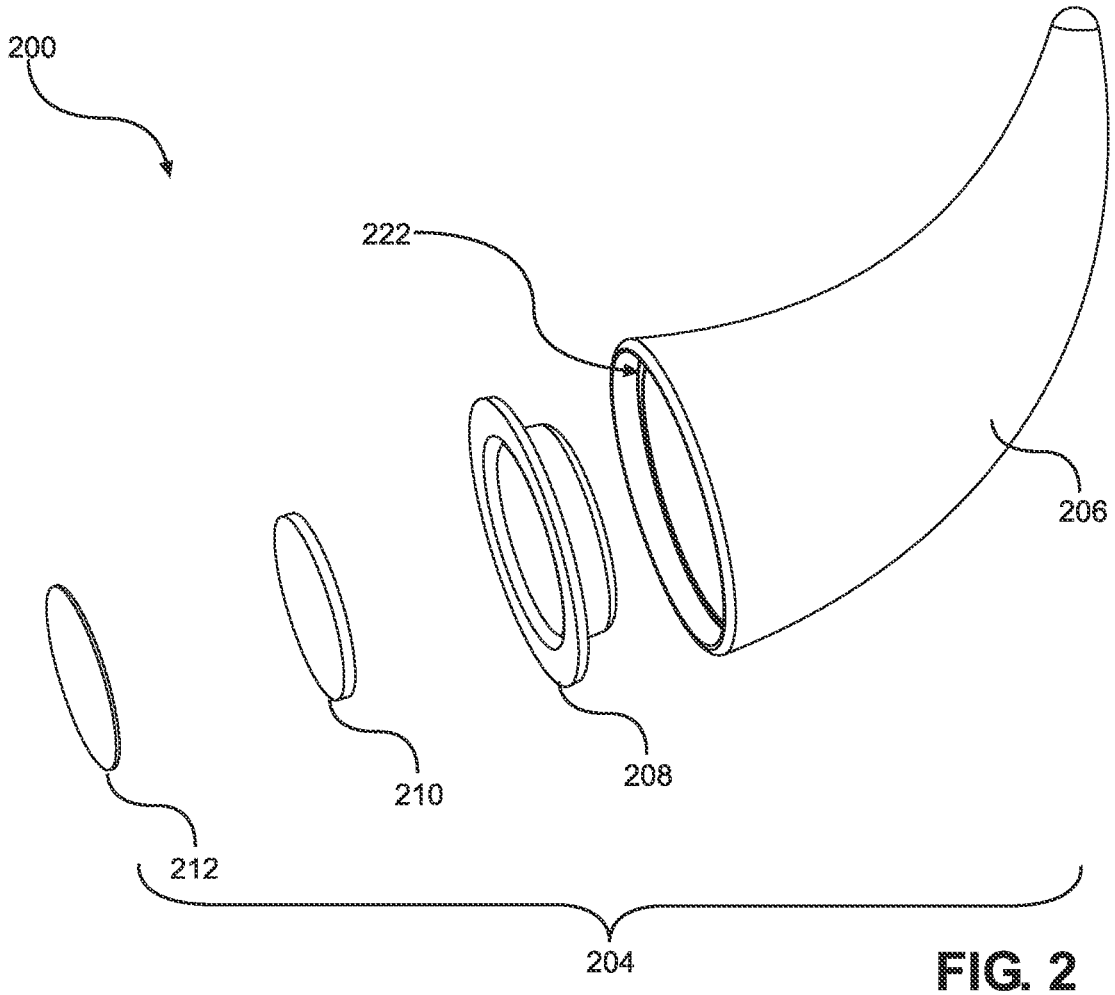
FIG. 2 is a perspective view of an example decorative top in a magnet-based mounting system in accordance with examples as disclosed herein.

FIG. 2 is a perspective view of an example decorative top 204 in a magnet-based mounting system 200, and in other embodiments described in the figures. For purposes of illustration, the attachment shown in FIG. 2 is a decorative top, but the attachment may include any decorative item or functional attachment (e.g., lights, GPS, music, or other features) with the same magnet-based mounting components (e.g., the mount plate, the adhesive, the metal disk) to adhere a magnetic base on or integrated into a helmet.

The decorative top 204 includes a decorative unit 206, a mount plate 208 to mount into the decorative unit 206, a first adhesive 210 to secure the mount plate 208 to the decorative unit 206, a metal disk 212 to adhere to the mount plate 208. The decorative unit 206 in FIGS. 1 and 2 is a large animal horn but may be other shapes (e.g., kitty ears, banana, unicorn). A second adhesive 222 may also be included to secure the metal disk 212 to the mount plate 208.

Figure 3:
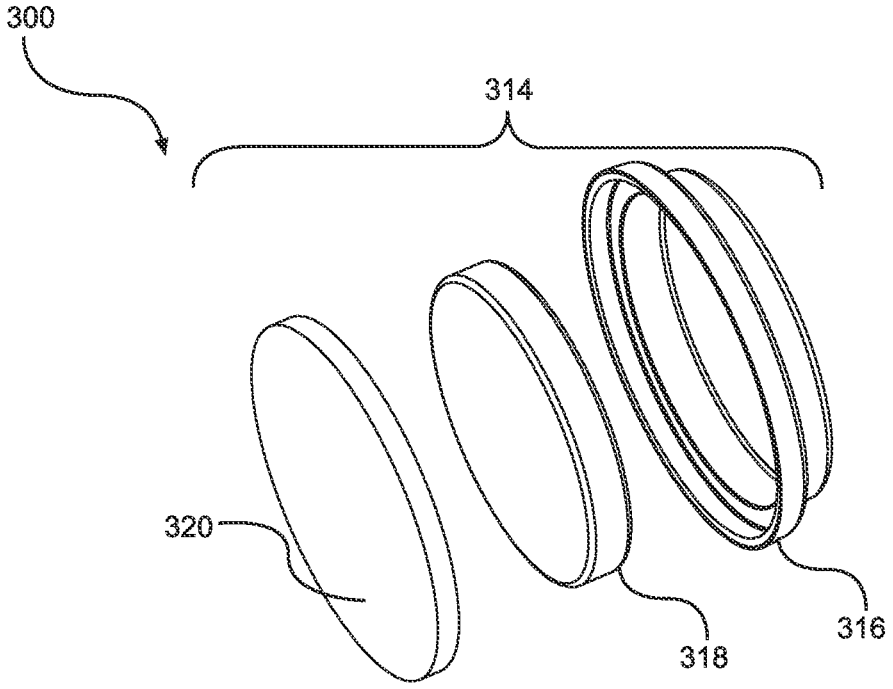
FIG. 3 is a perspective view of an example magnetic base in a magnet-based mounting system in accordance with examples as disclosed herein.

FIG. 3 is a perspective view of an example magnetic base in a magnet-based mounting system 300 that is mounted on an internal or external surface of a helmet or integrated into a helmet.

The magnetic base 314 includes a mount cover 316, a magnet 318 to adhere to the mount cover 316, and a third adhesive 320 to secure the mount cover 316 to the magnet 318.

The mount cover may be made of various materials (e.g., an injection molded plastic). The magnet may be a rare earth magnet (e.g., neodymium).

The magnetic base 314 may be attached to the inside or the outside of a helmet by the third adhesive 320. Specifically, in an embodiment where the mounting system 300 is attached to the helmet, the magnetic base 314 may be attached to an inside surface or the outside surface of a helmet. The third adhesive 320 may be used on both sides of the magnet 318 to attach the magnet 318 to the inside of the mount cover 316 and to a surface of the helmet.

In an embodiment where the mounting system 300 is integrated into the helmet, a cavity (or cavities) may be formed in the helmet and the magnetic base 314 may be implanted into the cavity and attached to the interior of the helmet in the cavity. The magnetic base 314 may be temporarily or permanently integrated into the helmet.

Figure 4A:
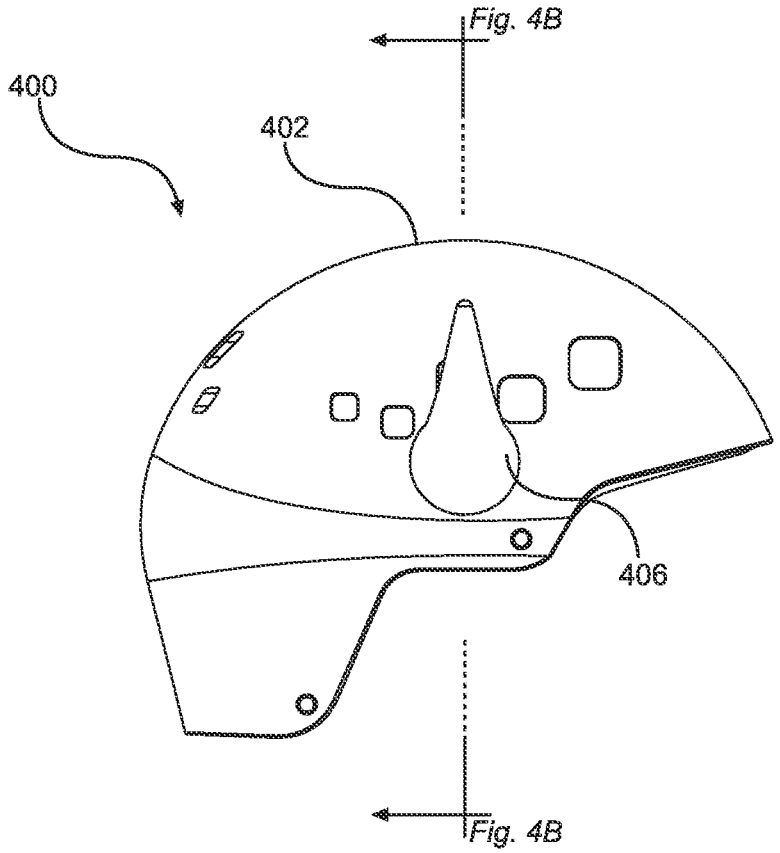
FIG. 4A is a side view of an example magnet-based mounting system in accordance with examples as disclosed herein.
Figure 4C:
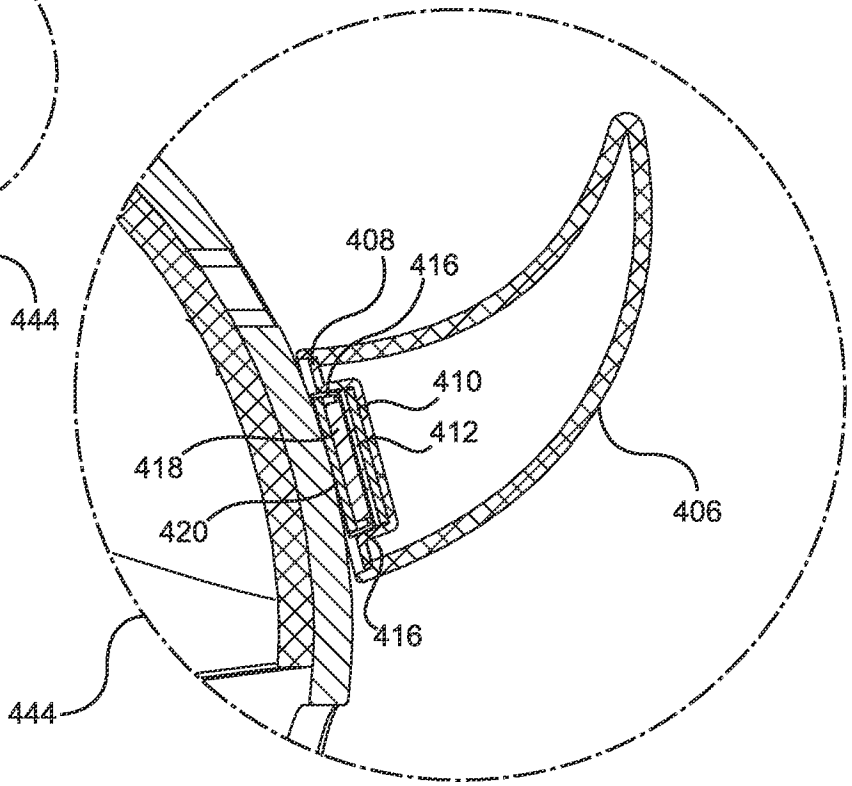
FIG. 4C is a partial cross-sectional front view of an example magnet-based mounting system in accordance with examples as disclosed herein.
Figure 4B:
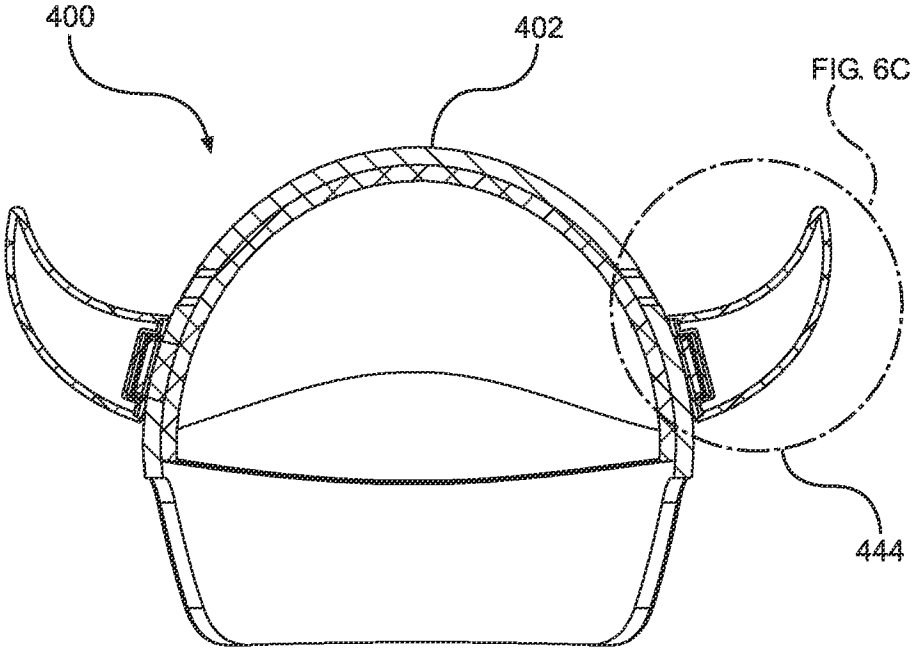
FIG. 4B is a cross-sectional front view of an example magnet-based mounting system in accordance with examples as disclosed herein.

FIG. 4A is a side view of an example externally mounted magnet-based mounting system 400 and a helmet 402. FIG. 4B is a cross-sectional front view of the example magnet-based mounting system 400 and the helmet 402 in FIG. 4A, correlating to the cross-section "A" marked in FIG. 4A. FIG. 4C is a partial cross-sectional front view of an example magnet-based mounting system and the helmet 402. Specifically, FIG. 4C is an enlarged view 444 of the mounting system 400, correlating to the circled feature "B" in FIG. 4B. The magnets in FIGS. 4A-C may be affixed to an exterior surface of the helmet. In other embodiments, it is contemplated that magnets may be affixed to an interior surface of the helmet. The magnet-based mounting system 400 may be used to mount attachments (e.g., decorative units) to an exterior surface of a helmet 402. In other embodiments, the attachments may be other functional or accessory features.

As shown, the magnet-based mounting system 400 a decorative top 404, and a magnetic base 414. The magnetic base 414 is coupled to the decorative top 404 to the helmet 402 by a magnet.

The decorative top 404 includes a decorative unit 406, a mount plate 408 to mount into the decorative unit 406, a first adhesive 410 to secure the mount plate 408 to the decorative unit 406, a metal disk 412 to adhere to the mount plate 408. A second adhesive (not shown) may also be included to secure the metal disk 412 to the mount plate 408.

The magnetic base 414 includes a mount cover 416, a magnet 418 to adhere to the mount cover 416, and a third adhesive 420 to secure the mount cover 416 to the magnet 418. In FIG. 4C, the side of the mount cover 416 are shown. The top of the mount cover 416 (not shown) may be approximately 0.25-0.75 mm thick to reduce interference between the magnet 418 and the metal disk 412.

Figure 5:
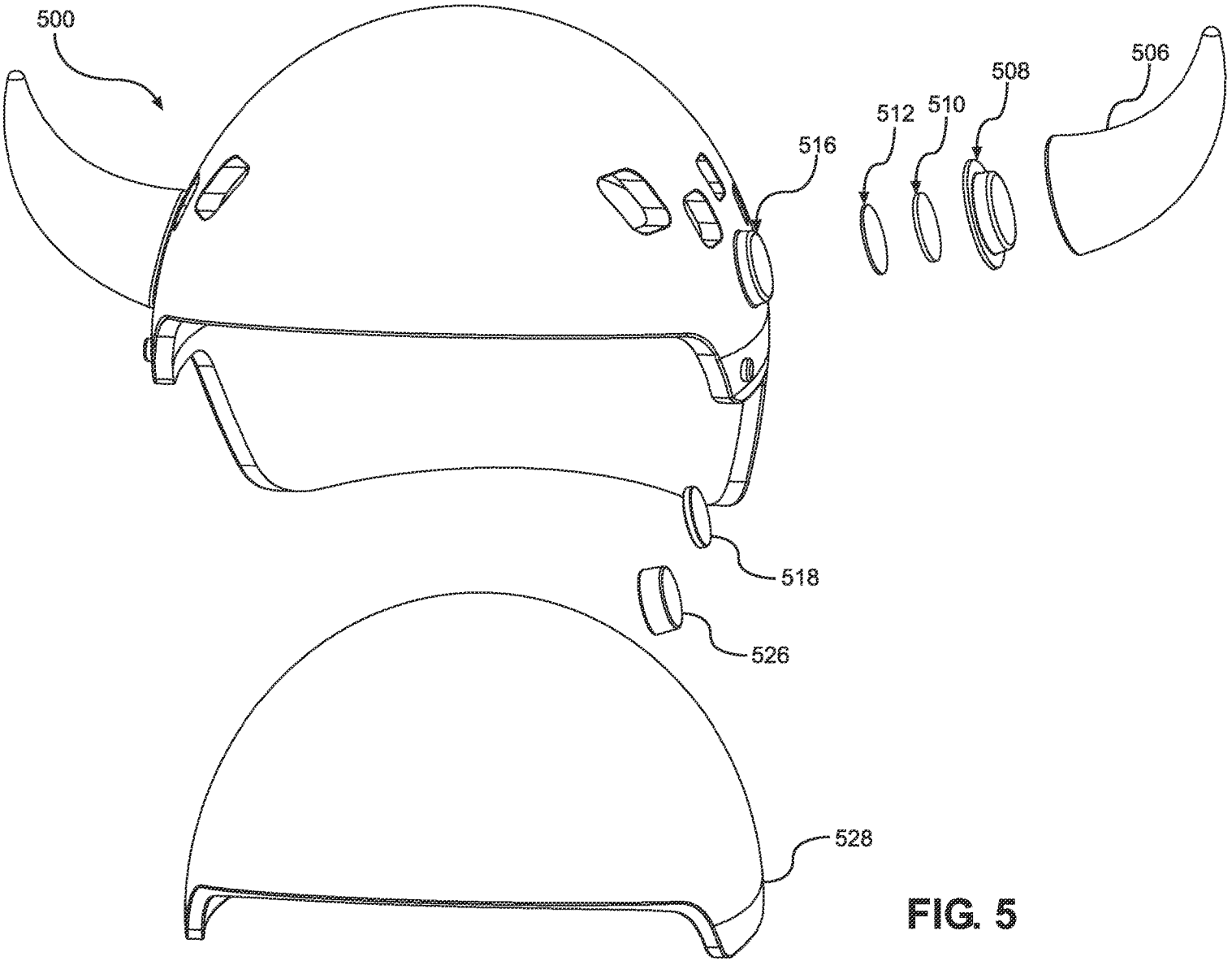
FIG. 5 is a perspective view of an example magnet-based mounting system in accordance with examples as disclosed herein.

FIG. 5 is a perspective view of an example magnet-based mounting system 500. Specifically, a "helmet system" is shown with the magnet-based mounting system 500 integrated in a helmet 502 to mount attachments (e.g., decorative units) to the helmet 502. In other embodiments, the attachments may be other functional or accessory features.

As shown, the magnet-based mounting system 500 includes two decorative tops 504 (one of which is unassembled to display the components parts), and a magnetic base 514 (which is unassembled to display the components parts). The magnetic base 514 is coupled to the decorative top 504 to the helmet 502 by a magnet 518.

The decorative top 504 includes a decorative unit 506, a mount plate 508 to mount into the decorative unit 506, a first adhesive 510 to secure the mount plate 508 to the decorative unit 506, a metal disk 512 to adhere to the mount plate 508. A second adhesive (not shown) may also be included to secure the metal disk 512 to the mount plate 508.

The magnetic base 514 includes a mount cover 516, a magnet 518 (shown in FIG. 6C) to adhere to the mount cover 516, and an adhesive 520 (shown in FIG. 6C) to secure the mount cover 516 to the magnet 518. The mount cover 516, which may be plastic, encases the magnet 518 to protect the magnet 518 from damage. In some implementations, adhesive may be used on both sides of the magnet 518 to attach the magnet 518 to both the inside of the mount cover 516 and to the surface of the helmet 502 itself.

Figure 6A:
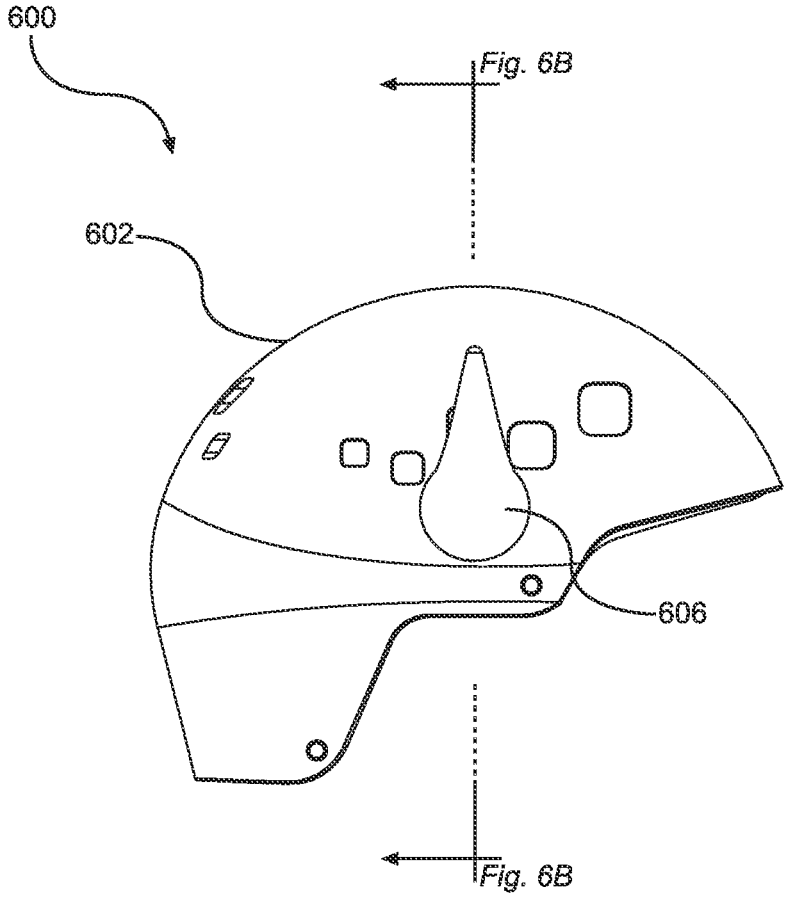
FIG. 6A is a side view of an example magnet-based mounting system.
Figure 6C:
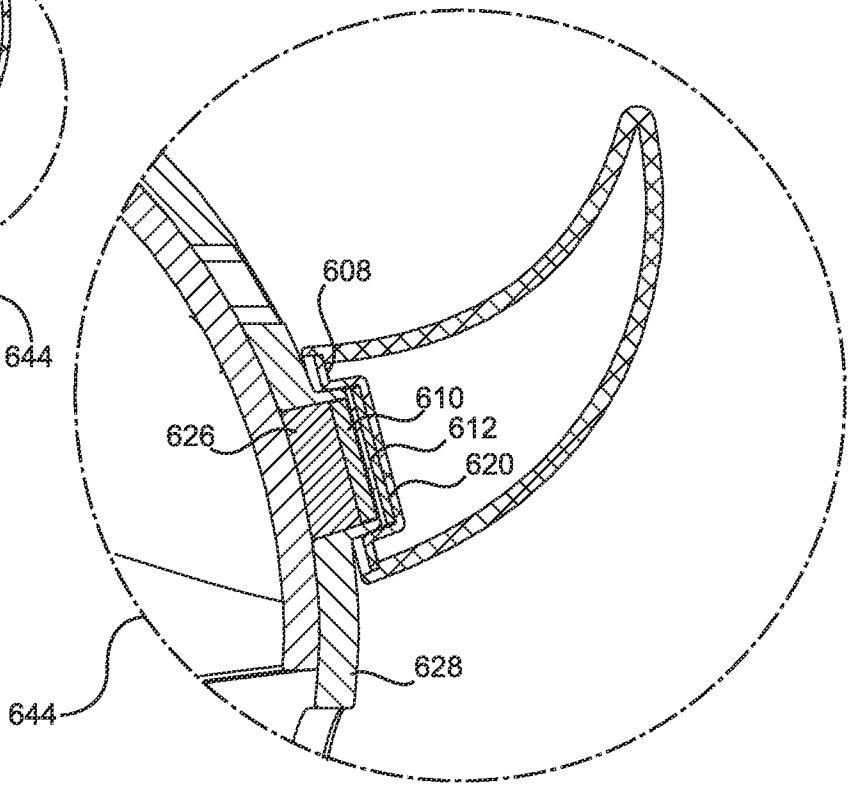
FIG. 6C is a partial cross-sectional front view of an example magnet-based mounting system in accordance with examples as disclosed herein.

In a helmet system where the magnet-based mounting system 500 is integrated into the helmet, the mount cover 516, the magnet 518 and the adhesive 520 may be located or partially located in a cavity in the liner (shown as helmet liner 628 in FIG. 6C). For example, in some implementations, the mount cover 516, the magnet 518 and the adhesive 520 may all be located in the helmet liner, with some components flush with the exterior surface of the helmet 502. In other implementations, the mount cover 516 or other components may be located partially out of the helmet or out of the helmet while affixed to the other components of the magnetic base located in the helmet. In some implementations, a filler, foam or other material 626 may be used to fill in areas around the mount cover 516 and the magnet 518. Various methods of integrating the magnet and magnet cover into the helmet are contemplated.

The magnet-based mounting system 500 may include any number of decorative units 106, or other features requiring a magnet-based mounting system for attachment to a helmet. The components of the magnet-based mounting system 500 may be made of various materials. For example, the adhesives (e.g., the first adhesive 510, the second adhesive (shown in FIG. 2, as 222, the third adhesive 120) may be adhesive tapes or other adhesive products (e.g., 3M™ VHB™ Tapes, a liquid adhesive, a double-sided adhesive, etc.). A variety of magnets may be used, such as rare-earth magnets (e.g., neodymium). The metal disk 512 may be any metal (e.g., steel) that are attracted by a magnetic force to magnets sufficiently to affix decorative items and other features to a helmet. The mount plate 508 may be made of various materials, and in some cases, may be molded.

Figure 6B:
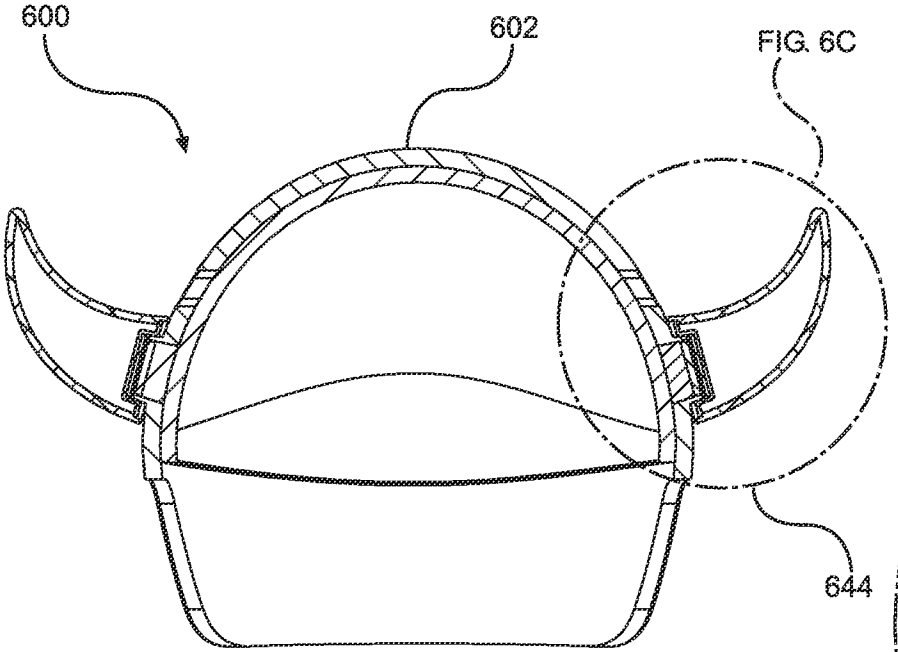
FIG. 6B is a cross-sectional front view of an example magnet-based mounting system in accordance with examples as disclosed herein.

FIG. 6A is a side view of an example magnet-based mounting system 600 and a helmet 602, or "helmet system." FIG. 6B is a cross-sectional front view of the example magnet-based mounting system 600 in FIG. 6A, correlating to the cross-section "A" marked in FIG. 6A. FIG. 6C is a partial cross-sectional front view of an example magnet-based mounting system. Specifically, FIG. 6C is an enlarged view 644 of the mounting system 600, correlating to the circled feature "B" in FIG. 6B. The magnets in FIGS. 6A-C are embedded into the exterior surface of the helmet 602. The magnet-based mounting system 600 may be used to mount attachments (e.g., decorative units) to an exterior surface of a helmet 602. In other embodiments, the attachments may be other functional or accessory features.

As shown, the magnet-based mounting system 600 includes a decorative top 604, and a magnetic base 614. The magnetic base 614 is coupled to the decorative top 604 to the helmet 602 by a magnet.

The decorative top 604 includes a decorative unit 606, a mount plate 608 to mount into the decorative unit 606, a first adhesive 610 to secure the mount plate 608 to the decorative unit 606, a metal disk 612 to adhere to the mount plate 608. A second adhesive (not shown) may also be included to secure the metal disk 612 to the mount plate 628.

The magnetic base 614 includes a mount cover 616, a magnet 618 to adhere to the mount cover 616, and a third adhesive 620 to secure the mount cover 616 to the magnet 618.

In a helmet system where the magnet-based mounting system 600 is integrated into the helmet, the mount cover 616, the magnet 618 and the adhesive 620 may be located or partially located in a cavity in the helmet liner 628. For example, in some implementations, the mount cover 616, the magnet 618 and the adhesive 620 may all be located in the helmet liner, with some components flush with the exterior surface of the helmet 602. In other implementations, the mount cover 616 or other components may be located partially out of the helmet or out of the helmet while affixed to the other components of the magnetic base located in the helmet. In some implementations, a filler material or other material 626 may be used to fill in areas around the mount cover 616 and the magnet 618. Various methods of integrating the magnet and magnet cover into the helmet are contemplated.

Figure 7A:
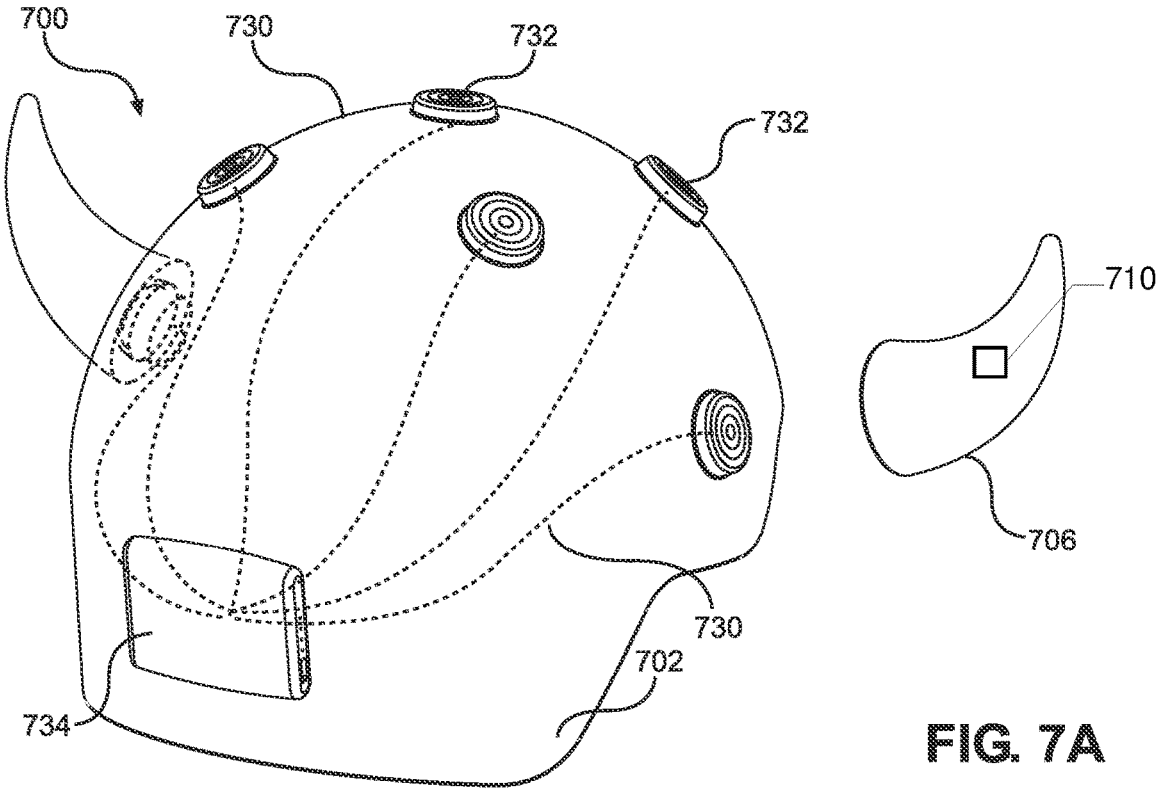
FIG. 7A is a cross-sectional perspective view of an example magnet-based mounting system in accordance with examples as disclosed herein.
Figure 7B:
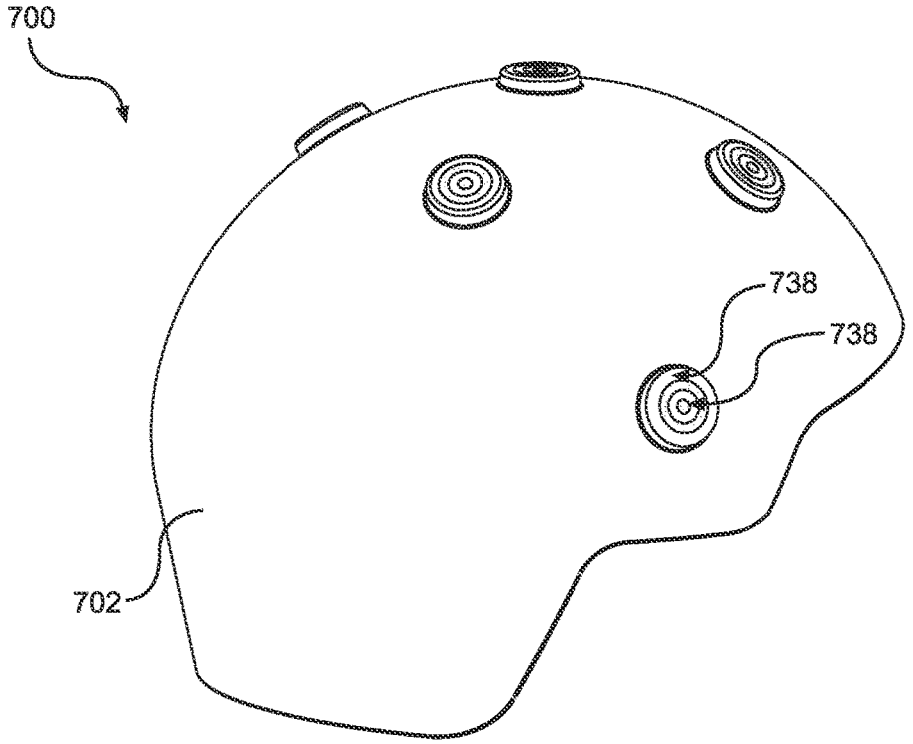
FIG. 7B is a perspective view of an example magnet-based mounting system in accordance with examples as disclosed herein.

FIG. 7A is a cross-sectional perspective view of an example magnet-based mounting system 700 that includes an integrated power supply system in a helmet 702 with electronic communication between components. FIG. 7B is a perspective view of the example magnet-based mounting system 700 in FIG. 7A. Specifically, a helmet 702 is shown with a power source 734 (e.g., a battery pack with USB charging capabilities), which may be located on an interior or exterior surface of the helmet 702 (e.g., under a shell of the helmet) or integrated into the helmet 702. The power source 734 may be attached by a variety of attaching means (e.g., an adhesive or integrated into the helmet similar to the mounting system being integrated into the helmet). The power source 734 provides power through conductive wires 730, which are integrated in the helmet 702.

The conductive wires 730 run to and have conductive conduct with conductive magnetic mount points 732, which may be integrated into the helmet 702 as part of the magnet-based mounting system or affixed to an external surface of the helmet 702. The magnetic mount points 732 at least one magnetic base (e.g., shown as concentric circles of conductive material 738) on the magnets. The magnetic mount point 732 magnet may be configured in a mount cover. The helmet 702 is charged via the centralized power supply to provide power to attachments (not shown) that are adhered to the magnetic mount points 732 similar to the magnetic bases.

Figure 8:
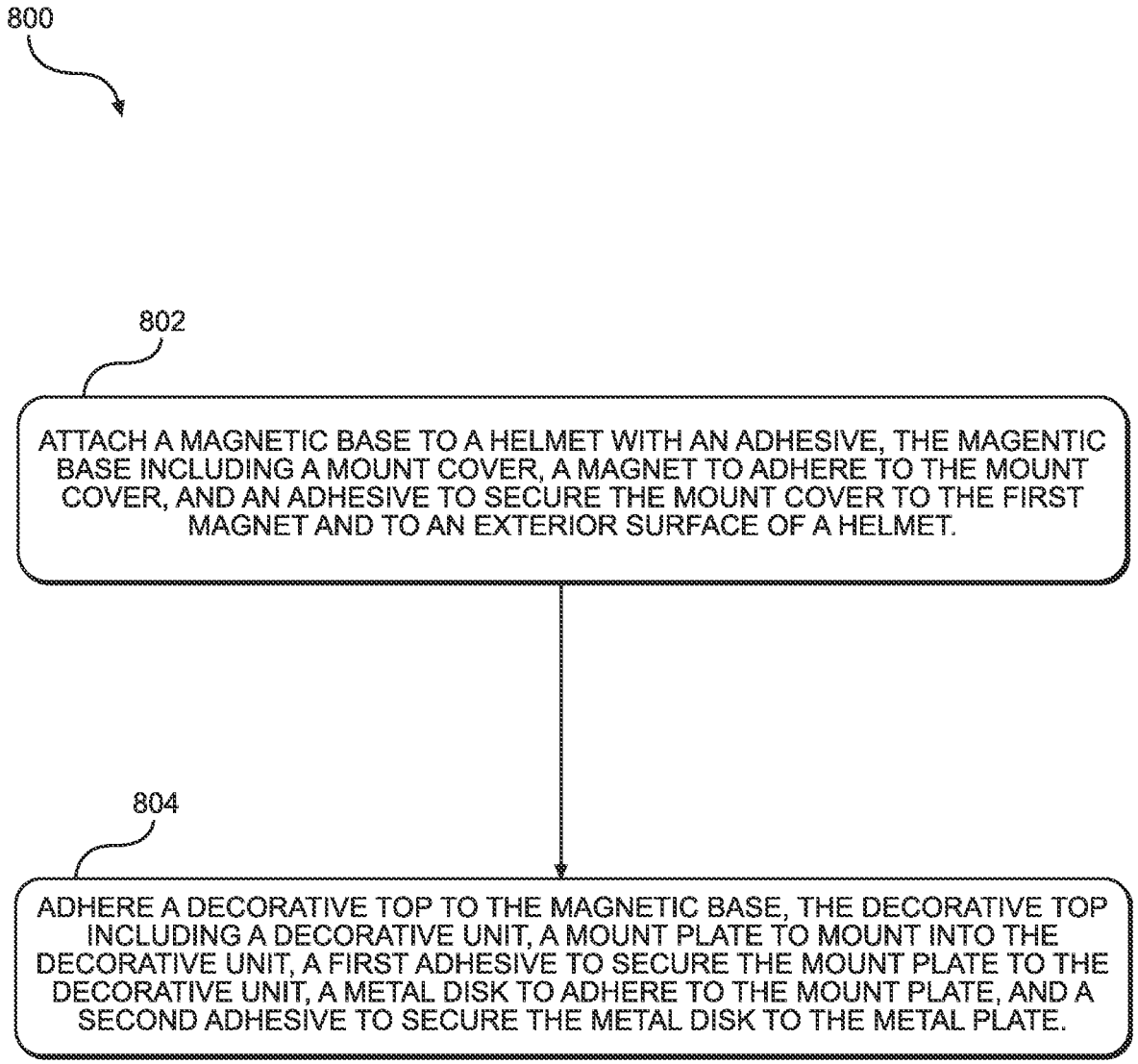
FIG. 8 is a flowchart of example operations for using magnet-based mounting system in accordance with examples as disclosed herein.

FIG. 8 is a flowchart of example operations 800 for using magnet-based mounting system. In some embodiments, a helmet system may include a helmet and a magnet-based mounting system integrated in the helmet. In other embodiments, a magnet-based mounting system may be a separate system, including a decorative top (which includes a decorative unit) and a magnetic base. Prior to using the separate system, a user will clean the helmet surface before affixing a magnet-based mounting system to the helmet, for example, with an alcohol swab.

In operations 800, a method of attaching a decorative top to a helmet in a magnet-based mounting system is described. In an operation 802, a magnetic base is attached to a helmet with an adhesive. The magnetic base includes a mount cover, a magnet to adhere to the mount cover, and an adhesive to secure the mount cover to the first magnet and to an exterior surface of a helmet. In some embodiments, the disclosed magnet-based mounting system includes at least one magnetic base that is integrated in the helmet, rather than to an exterior surface of a helmet. In such case, an operation 802 would include integrating the magnetic base into an exterior or interior surface of a helmet.

In an operation 804, a decorative top is adhered to the magnetic base. The decorative top includes a decorative unit, a mount plate to mount into the decorative unit, a first adhesive to secure the mount plate to the decorative unit, a metal disk to adhere to the mount plate, and a second adhesive to secure the metal disk to the mount plate.

To remove the decorative top from the magnetic base, a user can pull the decorative top off the magnetic base, thereby disrupting the magnetic attraction between the metal in the decorative top and the magnet in the magnetic base.

In some implementations, the method for using the magnet-based mounting system includes utilizing a power source coupled to attachments with power connectivity. In some implementations, the power will be provided from the power source through wiring integrated in or on the helmet to magnetic mounts or magnetic bases that are affixed to the helmet or integrated in the helmet. The magnets may be used for switching and in some implementations, include conductive material for providing power to components that may be coupled to the magnetic mounts or magnetic bases, such a lights, music, wireless technology, via an attachment, which includes the metal disk that adheres to the magnet located in each magnetic mount or magnetic base.

Specifically, a power source may be located on an interior or exterior surface of the helmet (e.g., under a shell of the helmet) or integrated into the helmet. The power source may be attached by a variety of attaching means (e.g., an adhesive or integrated into the helmet similar to the mounting system being integrated into the helmet). The power source provides power through conductive wires, which are integrated in the helmet.

The conductive wires run to conductive magnetic mount points, which may be integrated into the helmet as part of the magnet-based mounting system or affixed to an external surface of the helmet. The magnetic mount points include magnets and may be configured in a mount cover. The helmet is charged via the centralized power supply to provide power to attachments that are adhered to the magnetic mount points similar to the magnetic bases.

In other operations, the disclosed technology includes methods of manufacturing magnet-based mounting systems. In some implementations, operations may include manufacturing a magnetic base, and the following components of the magnetic base: a mount cover, a magnet to adhere to the mount cover, and an adhesive to secure the mount cover to the first magnet and to an exterior surface of a helmet. In some implementations, operations may include manufacturing an attachment (described herein as a decorative top), and the following components of the decorative top: a decorative unit, a mount plate to mount into the decorative unit, a first adhesive to secure the mount plate to the decorative unit, a metal disk to adhere to the mount plate, and a second adhesive to secure the metal disk to the mount plate.

In some implementations, the components manufactured may be made of various materials and the mounting systems may include various features. For example, the disclosed magnet-based mounting system may include a disk made of any metal (e.g., steel, iron, nickel, etc.) attracted to magnets. The magnets are contemplated to be any strong magnets. In some embodiments, the magnets are rare earth magnets, such as neodymium or samarium-cobalt magnets. In some embodiments, LED lights 710 (shown in FIG. 7A), music, video, GPS, wireless technology or other features may be integrated into the magnetic latching system. The magnets in the mounting systems may be used for switching for the LED lights or other features. In some embodiments, the decorative unit comprises a cavity for electrical components or storage of other components. For example, a cavity inside the decorative top may allow for space to add features such as Bluetooth connectivity for smart navigation features such as turn signals for cyclists.

In some embodiments, a power source (e.g., a battery pack) may be manufactured to attach to the mounting system (e.g., the decorative top) or to a helmet. Electrical wiring may be integrated into the helmet to power the magnetic bases. In some embodiments, the helmet may be manufactured with a conductive surface.

If additional holding power is required for a heavier attachment, additional corresponding magnets may be installed to increase the holding force to the helmet. For example, a decorative top may include a heavier attachment. The decorative top may have a corresponding magnet installed, in addition to the magnet located in the magnetic base. This will increase the holding force of the decorative top to the magnetic base and the helmet.

It should be noted that these methods describe examples of embodiments, and that the operations and the steps may be rearranged or otherwise modified such that other embodiments are possible. In some examples, aspects from two or more of the methods may be combined. For example, aspects of each of the methods may include steps or aspects of the other methods, or other steps or techniques described herein. Thus, aspects of the disclosure may provide for consumer preference and maintenance interface.

The terms "electronic communication," "conductive contact," "connected," and "coupled" may refer to a relationship between components that supports the flow of signals between the components. Components are considered in electronic communication with (or in conductive contact with or connected with or coupled with) one another if there is any conductive path between the components that can, at any time, support the flow of signals between the components. At any given time, the conductive path between components that are in electronic communication with each other (or in conductive contact with or connected with or coupled with) may be an open circuit or a closed circuit based on the operation of the device that includes the connected components. The conductive path between connected components may be a direct conductive path between the components or the conductive path between connected components may be an indirect conductive path that may include intermediate components, such as switches, transistors, or other components. In some cases, the flow of signals between the connected components may be interrupted for a time, for example, using one or more intermediate components such as switches or transistors. As provided above, in some cases, the magnets may act as switches.

A switching component discussed herein may represent a device connected or coupled to electronic elements through conductive materials (e.g., magnets, conductive circles on the magnets, conductive surface of a helmet, etc.).

Components are also considered "coupled" with one another referring to a magnetic attraction relationship between components, such as rare-earth metals magnets and metal, when they attract and adhere to each other.

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details to providing an understanding of the described techniques. These techniques, however, may be practiced without these specific details. In some instances, well-known structures and devices are shown in block diagram form to avoid obscuring the concepts of the described examples.

In the appended figures, similar components or features may have the same (or similar, e.g., the two last numbers being the same) reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label.

The description herein is provided to enable a person skilled in the art to make or use the disclosure. Various modifications to the disclosure will be apparent to those skilled in the art, and the generic principles defined herein may be applied to other variations without departing from the scope of the disclosure. Thus, the disclosure is not limited to the examples and designs described herein but is to be accorded the broadest scope consistent with the principles and novel features disclosed herein.

What is claimed is:

1. A magnet-based mounting system, comprising:

at least one or more decorative tops, each decorative top including:

a decorative unit;

a mount plate mounted to the decorative unit;

a first adhesive securing the mount plate to the decorative unit;

a metal disk adhered to the mount plate; and a second adhesive securing the metal disk to the mount plate; and at least one magnetic base to connect a corresponding decorative top to a helmet, including:

a mount cover;

a first magnet adhered to the mount cover; and a third adhesive securing the mount cover to the first magnet and the first magnet to the helmet, wherein the at least one magnetic base and the first magnet is affixed on an exterior surface of the helmet.

2. The magnet-based mounting system of claim 1, wherein the at least one magnetic base is configured to be integrated in the helmet.

3. The magnet-based mounting system of claim 1, wherein the metal disk is made of steel.

4. The magnet-based mounting system of claim 1, wherein the first magnet is made of a rare-earth element.

5. The magnet-based mounting system of claim 1, wherein the first magnet is made of neodymium.

6. The magnet-based mounting system of claim 1, further comprising:

at least one LED light integrated into the at least one magnetic base.

7. The magnet-based mounting system of claim 1, wherein the first magnet is used for switching for the at least one LED light.

8. The magnet-based mounting system of claim 1, wherein the decorative unit comprises a cavity for electrical components.

9. The magnet-based mounting system of claim 1, further comprising:

wireless connectivity.

10. The magnet-based mounting system of claim 1, further comprising:

a power source.

11. The magnet-based mounting system of claim 10, wherein the power source is a battery.

12. The magnet-based mounting system of claim 1, wherein the decorative top is a powered attachment.

13. The magnet-based mounting system of claim 1, wherein the decorative top includes a second magnet.

14. A helmet system, comprising:

a helmet;

a power source;

a magnet-based mounting system including:

at least one or more decorative tops, each decorative top including:

a decorative unit;

a mount plate mounted to the decorative unit;

a first adhesive securing the mount plate to the decorative unit;

a steel disk adhered to the mount plate; and a second adhesive securing the metal disk to the mount plate; and at least one magnetic base integrated into the helmet to connect a corresponding decorative top to the helmet, including:

a mount cover;

a first neodymium magnet adhered to the mount cover; and a third adhesive securing the mount cover to the first magnet; and electrical wiring integrated into the helmet to transfer power from the power source to at least one component via the at least one magnetic base.

15. The helmet system of claim 14, wherein the helmet includes a conductive surface.

16. The helmet system of claim 14, further comprising:

electrical wiring integrated into the helmet to power the at least one magnetic base.

17. The helmet system of claim 14, further comprising:

conductive material located on the at least one magnetic base.

18. A method of attaching a decorative top to a helmet in a magnet-based mounting system comprising:

attaching a magnetic base to an exterior surface of a helmet with an adhesive, the magnetic base including:

a mount cover;

a first magnet adhered to the exterior surface of the helmet and the mount cover; and the adhesive also securing the mount cover to the first magnet and to the helmet; and adhering a decorative top to the magnetic base, the decorative top including:

a decorative unit;

a mount plate mounted to the decorative unit;

a first adhesive securing the mount plate to the decorative unit;

a metal disk adhered to the mount plate; and a second adhesive securing the metal disk to the mount plate.

* * * * *